US006249660B1

(12) United States Patent
Matsushita et al.

(10) Patent No.: US 6,249,660 B1
(45) **Date of Patent: *Jun. 19, 2001**

(54) IMAGING CARTRIDGE FOR USE IN AN IMAGE FORMING APPARATUS INCLUDING DETACHABLE ELECTRODE MEMBER

(75) Inventors: Kouji Matsushita; Yasuhiro Nakagami, both of Toyokawa (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/907,083

(22) Filed: Aug. 6, 1997

(30) Foreign Application Priority Data

Sep. 9, 1996 (JP) ..... 8-237918

(51) Int. Cl.[7] ..... G03G 15/02
(52) U.S. Cl. ..... 399/115; 399/171
(58) Field of Search ..... 399/115, 168, 399/170–173, 100, 108, 110, 111; 118/638; 361/225; 250/324

(56) References Cited

U.S. PATENT DOCUMENTS

| | | | | |
|---|---|---|---|---|
| 3,934,549 | * | 1/1976 | Davidson | 118/638 |
| 4,725,732 | | 2/1988 | Lang et al. . | |
| 4,984,018 | * | 1/1991 | Audou et al. | 399/110 |
| 5,063,409 | * | 11/1991 | Nakajima | 399/110 |
| 5,196,884 | * | 3/1993 | Sugiyama et al. | 399/111 |
| 5,488,222 | * | 1/1996 | Gault et al. | 250/324 |
| 5,774,324 | * | 6/1998 | Hayashi et al. | 361/225 |
| 5,812,359 | * | 9/1998 | Gross et al. | 361/225 X |

FOREIGN PATENT DOCUMENTS

| | | | |
|---|---|---|---|
| 2-48684 | * | 2/1990 | (JP) . |
| 2-173676 | * | 7/1990 | (JP) . |
| 4-133075 | | 5/1992 | (JP) . |
| 4-217276 | | 8/1992 | (JP) . |
| 5-46000 | | 2/1993 | (JP) . |
| 5-165302 | | 7/1993 | (JP) . |
| 5-265261 | * | 10/1993 | (JP) . |
| 6-149015 | * | 5/1994 | (JP) . |
| 8-76556 | * | 3/1996 | (JP) . |
| 8-110676 | * | 4/1996 | (JP) . |
| 8-160712 | * | 6/1996 | (JP) . |

* cited by examiner

*Primary Examiner*—Quana M. Grainger
(74) *Attorney, Agent, or Firm*—Burns, Doane, Swecker & Mathis, LLP

(57) ABSTRACT

In an imaging cartridge for forming images at least including a corona charging device and an object to be charged, a discharging electrode unit in the corona charging device is supported in such a manner that the electrode unit can be separately detached therefrom and installed thereto without being obstructed by the object to be charged or by a grid electrode from a side opposite to the member to be charged.

11 Claims, 15 Drawing Sheets

IMAGING CARTRIDGE FOR USE IN AN IMAGE FORMING APPARATUS INCLUDING DETACHABLE ELECTRODE MEMBER

BACKGROUND OF THE INVENTION

1. Field of the Invention

The present invention relates to an imaging cartridge having the function of forming images in a copying machine, fax machine, printer, image displaying apparatus or the like.

2. Description of Related Art

In the field of corona charging device which is incorporated in an imaging cartridge or the like, it has been devised that an electrode strip or a coronode with pin-like electrodes is held between insulating blocks and mounted to a shielding member, with a grid member mounted thereabove, as disclosed in Japanese Published Unexamined Patent Applications 4-133075 and 4-217276.

Other prior art arrangements include a corona charging device comprising a coronode with pin-like electrodes disposed in such a way that the pin-like electrodes are faced to an intermediate member arranged between the electrodes and a surface to be charged, as described in Japanese Published Unexamined Patent Application 5-165302. Also, Japanese Published Unexamined Patent Application 5-46000 discloses an arrangement in which an electrode unit comprising a pin corotron held between elongated support members is laterally slid into a matching concave of a main body of an apparatus for installation.

The entire body of an imaging cartridge had been conventionally constructed to be disposable, but it has recently been desired to produce reusable cartridges because of environmental problems. This trend has created significant requirements such as simplifying an exchanging operation of discharging members which tend to wear out most in a corona charging device, as well as simplifying the maintenance and repairing operation by a serviceman or a user.

However, an imaging cartridge is usually comprised of a corona charging device and an object to be charged, both of which function to form images, necessitating a complicated and troublesome exchanging operation, including the steps of dismounting the corona charging device and the object to be charged out of the imaging cartridge body, removing a grid member from the corona charging device, and taking out the discharging electrode members.

Further, in the above-described prior art arrangements, in order to remove the grid member, the corona charging device after being taken out from the imaging cartridge is first laid in such a way that the grid member faces upward, and the grid member is upwardly removed therefrom. The grid member may be deformed to contact thereto, causing damage to the discharging electrodes by external force during such operation or by inadvertently dropping the grid member. When the discharging electrodes are pin-like members, the electrodes may be bent or crushed by some chance, which causes irregular discharges and increases generation of ozone. When the discharging electrodes are wire members, the wire may be cut or a plated surface layer such as gold or the like may be peeled off by the above-mentioned inadvertent operations. There remain the same problems when installing the discharging electrodes, since the installing operation is similarly complicated such as having to mount the grid member after installing the discharging electrodes.

Thus, even a highly skilled serviceman needs quite a long time for repairing or maintenance, and it is very difficult for an ordinary user to exchange the discharging electrodes on his own. This operation could be easily done by the user if the entire corona charging device is to be exchanged, which means, however, that other elements that are still usable are wasted, and thus this approach is unacceptable from economical and ecological view points.

When the corona charging device has no grid members, the discharging electrodes can be more easily exchanged, but it is still rather troublesome to have to first dismount the corona charging device from the imaging cartridge before exchanging the electrodes.

BRIEF SUMMARY OF THE INVENTION

In view of the foregoing, it is a primary object of the present invention to provide an imaging cartridge for forming images comprising at least a corona charging device and an object to be charged, from which a discharging electrode member can be readily and quickly detached in a simple arrangement.

To accomplish said object, an imaging cartridge according to the present invention is comprised uniformly of at least a corona charging device and an object to be charged for forming images, in which a discharging electrode member in the corona charging device is held in such a manner that it is detached and installed on one side opposite to the side where the object to be charged is disposed.

According to the present invention, the discharging electrode member is detachably held in the corona charging device on the opposite side of the object to be charged, thus the object does not obstruct the operation of taking out or setting the electrode. Also, as the grid electrode is positioned between the discharging electrode member and the object to be charged, the discharging electrode member can be separately mounted thereto and dismounted therefrom without taking out the grid electrode or the object to be charged. This significantly simplifies the assembling operation, and facilitates a serviceman or a user to readily and quickly mount or dismount the discharging electrode member without letting it contact other members or falling it. The cost for maintenance or repair can be cut down, since the discharging electrode which tends tc wear out most is the only member to be exchanged, as well as the time required for operation is decreased.

Other and further objects, features and advantages of the invention will appear more fully from the following description.

DETAILED DESCRIPTION OF THE INVENTION

Preferred embodiments of the present invention will be hereinafter described in conjunction with the accompanying drawings.

(First Embodiment)

Figure 1:
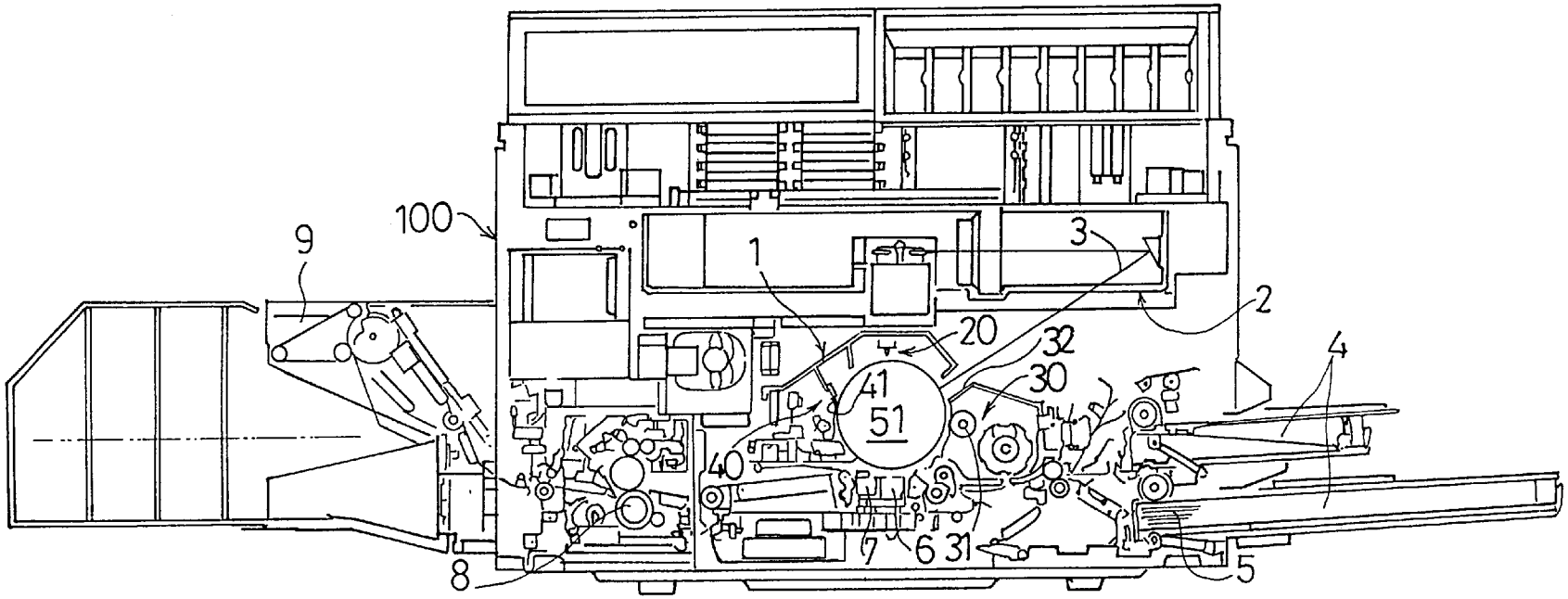
FIG. 1 is a sectional view showing a laser beam printer employing an imaging cartridge according to a first embodiment of the present invention.

A first embodiment of the present invention is an imaging cartridge 1 incorporated in a laser beam printer such as the one shown in FIG. 1. The imaging cartridge is equipped with a photosensitive drum 51 as an object to be charged, a corona charging device 20, an exposure incidence window 32, a developing device 30 with a developing magnet roll 31, and a cleaning unit 40 with a cleaning blade 41 all together therein, and installed in a printer body 100 with a printer head 2. The printer head 2 directs a laser beam 3 modulated by image signals onto the photosensitive drum 51, the surface of which has been sensitized by the corona charging device 20, to form a latent electrostatic image thereon. This is developed as a toner image by the developing device 30, which is then transferred onto a sheet 5 conveyed from a sheet feeder cassette 4 by a transfer charger 6 disposed in opposition to the photosensitive drum 51 in the printer body 100. The sheet 5 is separated from the photosensitive drum 51 by a separating charger 7 disposed adjacent to the transfer charger 6 after image transfer, and further conveyed to a fixing device 8 for image fixing, before discharged into a finishing device 9.

The imaging cartridge 1 performs a part of image forming as described above, and when it is necessary to repair or clean one of the devices included in the imaging cartridge 1, the entire body of the imaging cartridge 1 is extracted to the outside for a repairing or maintenance operation. The imaging cartridge 1 is also taken out when any other devices installed within the printer body 100 require some repairs or when a paper gets jammed in the printer for facilitating an operation. Further, some of expendable devices or members disposed within the imaging cartridge 1 may be encased in a cartridge to be easily mounted to or dismounted from the imaging cartridge 1.

Thus, there may be a variety of arrangements in number and type of devices mounted to the imaging cartridge 1 which is detachably installed in an image forming apparatus such as a printer. The present invention is thus not limited to the imaging cartridge 1 incorporated in the printer body 100 as in this embodiment, but may be applied to any other cartridge having at least the photosensitive drum 51 as an object to be charged and the corona charging device 20 working together for forming images, and at least a coronode or an electrode member 21 in the corona charging device 20 may be detachably mounted therein.

Figure 2:
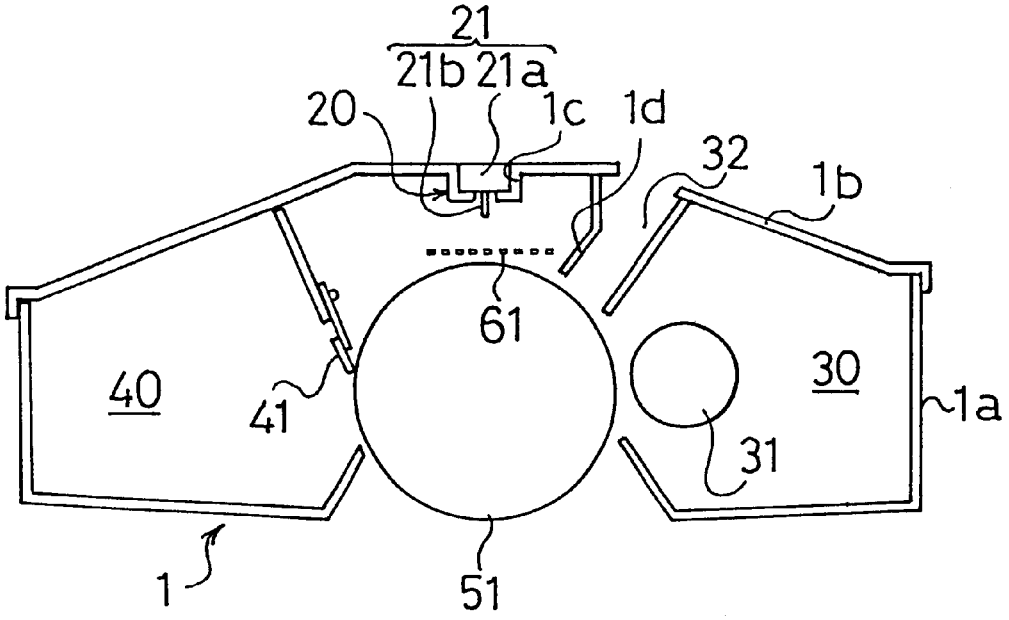
FIG. 2 is a sectional view showing the imaging cartridge incorporated in the printer of FIG. 1 in accordance with the first embodiment of the present invention.

The corona charging device 20 of this embodiment is used in combination with a scorotron grid 61 as shown in FIG. 2. A casing 1*a* of the imaging cartridge 1 has a detachable cover plate 1*b*, which includes a groove-like electrode supporting slot 1*c* partly being the exterior casing and upwardly opened. The corona charging device 20 comprises this electrode supporting slot 1*c* and the electrode member 21, which is mounted from above into the supporting slot 1*c*. The electrode member 21 is made of an insulating material such as synthetic resin and comprised of an electrode mold 21*a* retained by the supporting slot 1*c* and a discharging point 21*b* protruding from the electrode mold 21*a* through the bottom face of the supporting slot 1*c* toward the photosensitive drum 51 when the electrode mold 21*a* is received by the supporting slot 1*c*. The discharging point 21*b* projected in this way is positioned to face the photosensitive drum 51 for charging the surface thereof.

The scorotron grid 61 is disposed between the discharging point 21*b* of the electrode member 21 and the photosensitive drum 51, and is detachably retained beside a shielding wall 1*d* of the casing 1*a*, in order to predeterminedly control the amount of charge applied to the surface of the photosensitive drum 51 from the discharging point 21*b* in accordance with grid voltage applied to the scorotron grid 61.

The electrode mold 21*a* is constructed to be magnetic and attracted to a magnetic substance (not shown) partly constituting the electrode supporting slot 1*c*, whereby the electrode member 21 is firmly yet detachably retained in the supporting slot 1*c*. To retain the electrode member 21 by magnetic attraction, in contrast with the arrangement described above, a magnetic substance may be employed as a part of the electrode mold 21*a* and a part of the support slot 1*c* may be constructed to be magnetic. The electrode member 21 may be detachably mounted by any other methods such as bonding the electrode member 21 received in the supporting slot 1*c* to the cover plate 1*b* by an adhesive tape.

Figure 3:
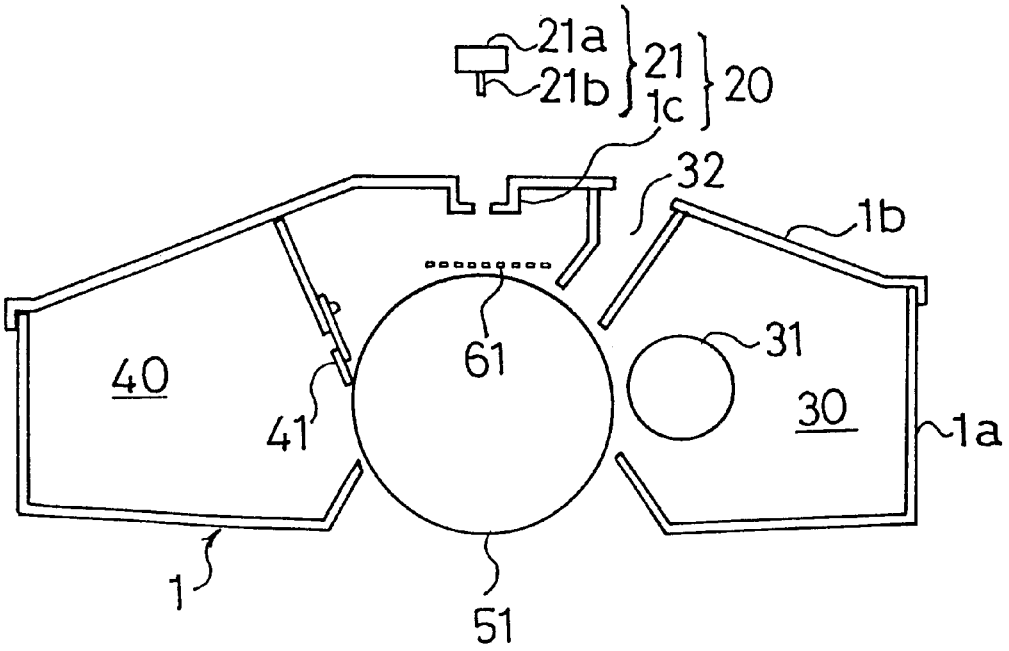
FIG. 3 is a sectional view showing the imaging cartridge of FIG. 2, with an electrode member taken out therefrom.

As set forth above, the corona charging device 20 according to the first embodiment of the present invention has its electrode member 21 detached from the electrode supporting slot 1*c* which is opened and positioned on the opposite side of the photosensitive drum 51 in the imaging cartridge. The electrode member 21 can be separately removed from the electrode supporting slot 1*c* of the corona charging device 20 without being obstructed by the photosensitive drum 51 as can be seen from FIG. 3. The electrode mold 21*a* may further have a tab to more easily pick up the electrode member.

Even when the corona charging device 20 is used in combination with the scorotron grid 61 as in this embodiment, the scorotron grid 61 does not obstruct the mounting or dismounting operation of the electrode member 21, as the grid 61 is positioned between the photosensitive drum 51 and the electrode member 21 as described above.

Accordingly, the electrode member 21 can be independently detached by a simple operation without dismounting the photosensitive drum 51 or the scorotron grid 61. It is thus easily and quickly mounted or dismounted in an assembly process of production or in other operations by a serviceman or a user. It is prevented that the electrode member 21 may be damaged by contacting other members or falling. The time and cost for maintenance can be reduced owing to the simplified operation and the decreased number of parts to be exchanged.

Figure 4:
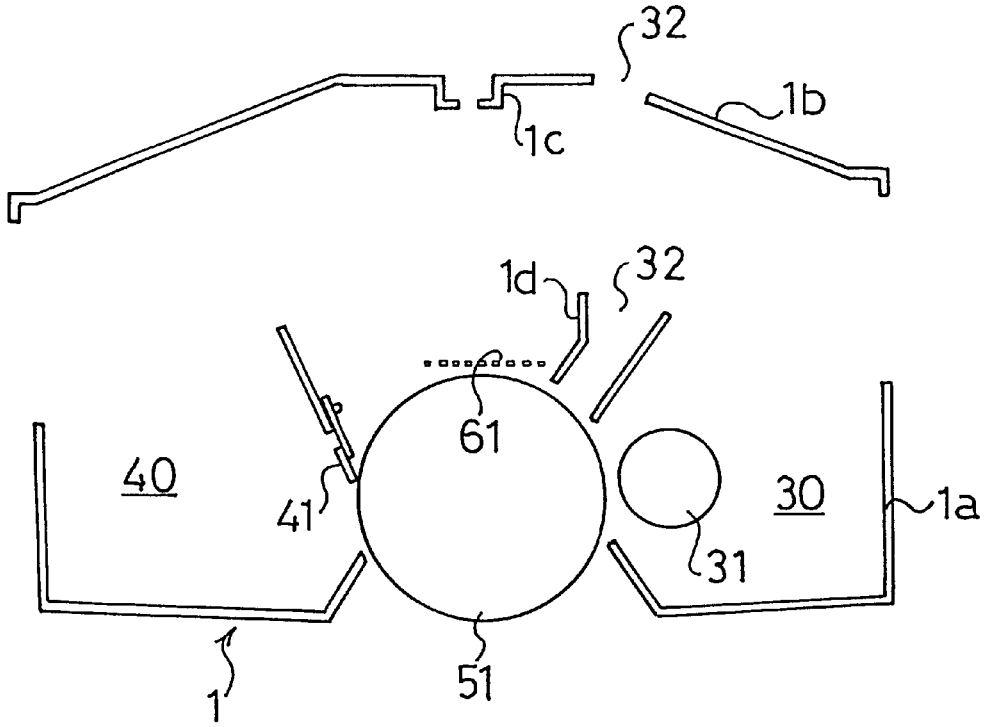
FIG. 4 is a sectional view showing the imaging cartridge of FIG. 3, with a cover plate taken out therefrom.

In order to mount or dismount the scorotron grid 61, the electrode member 21 and the electrode supporting slot 1*c* need to be taken out. This embodiment also allows for the easy removal of the scorotron grid 61 by forming the supporting slot 1*c* integrally with the cover plate 1*b* of the casing 1*a*. It is thus only necessary to remove the cover plate 1*b* from the casing 1*a* as shown in FIG. 4, irrespective of whether the electrode member 21 is mounted or not, as a result of which the scorotron grid 61 is exposed. The scorotron grid 61 can be then separately dismounted therefrom without being obstructed by the photosensitive drum 51.

Accordingly, the scorotron grid 61 can be independently detached as simply as the electrode member 21, by which assembly process in production or any other operations by a serviceman or a user are greatly simplified. It is prevented that the scorotron grid 61 may be damaged by contacting other members or falling. The time and cost for maintenance can be reduced owing to the simplified operation.

(Second Embodiment)

Figure 5:
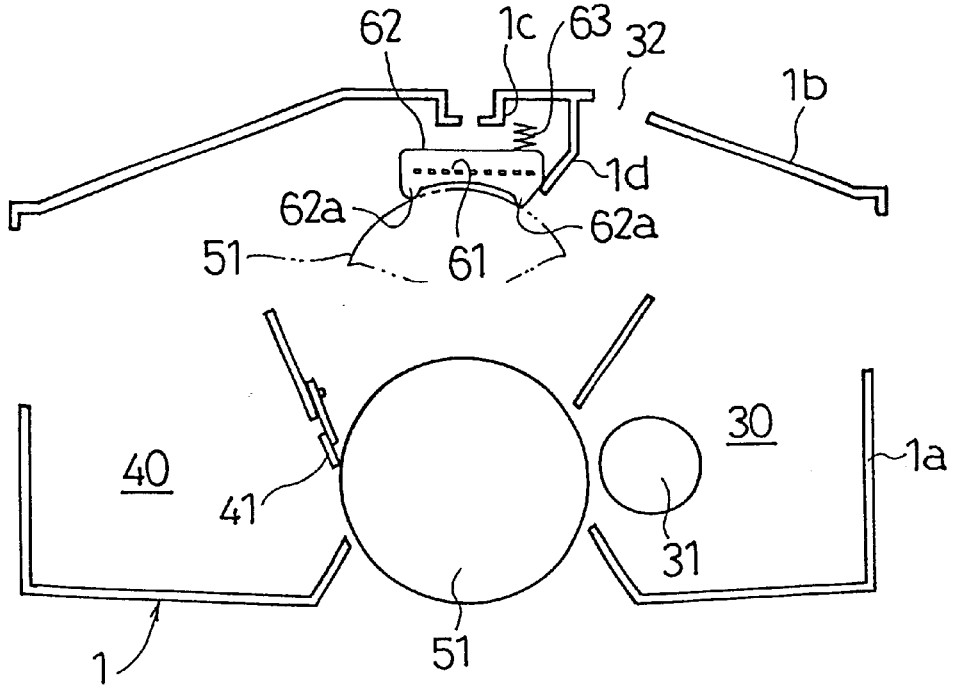
FIG. 5 is a sectional view showing an imaging cartridge in accordance with a second embodiment of the present invention, with a cover plate taken out therefrom.

FIG. 5 shows a second embodiment of the present invention, which differs from the first embodiment only in that the scorotron grid 61 is detachably retained in a grid support member 62 beside the shielding wall 1*d* which is uniformly made with the cover plate 1*b*. Other parts identical to those previously described with reference to the first embodiment are given the same numerals, and the description thereof will be omitted.

The grid support member 62 in this embodiment is floatingly supported on the cover plate 1*b* so as to cause the support member 62 to contact and separate from the photosensitive drum 51, for precisely controlling the distance between the photosensitive drum 51 and the scorotron grid 61. For this purpose, the grid support member 62 has positioning points 62*a* which directly contact with the photosensitive drum 51 at two points in a circumferential direction where images are not formed, or any other means having the same function, and is urged toward the photosensitive drum 51 by a spring 63. The distance between the scorotron grid 61 and the photosensitive drum 51 is thereby appropriately controlled.

According to this embodiment, the scorotron grid 61 can be separately taken out with the cover plate 1*b* from the casing la without being obstructed by the photosensitive drum 51, and further removed from the cover plate 1*b* for maintenance or a repairing operation.

(Third Embodiment)

Figure 6:
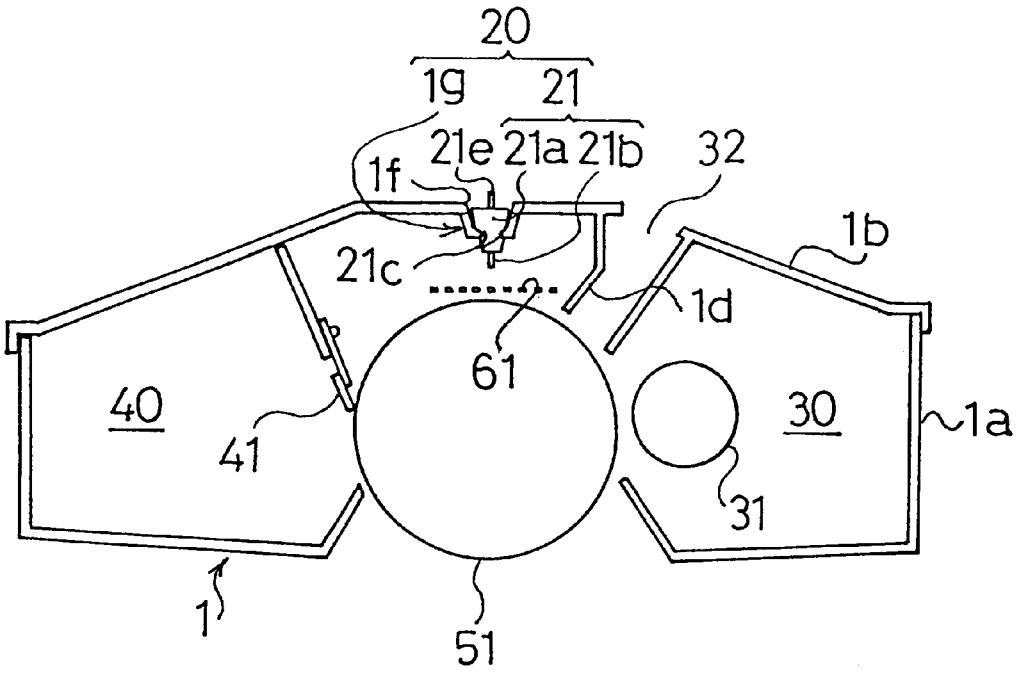
FIG. 6 is a sectional view showing an imaging cartridge in accordance with a third embodiment of the present invention.
Figure 7:
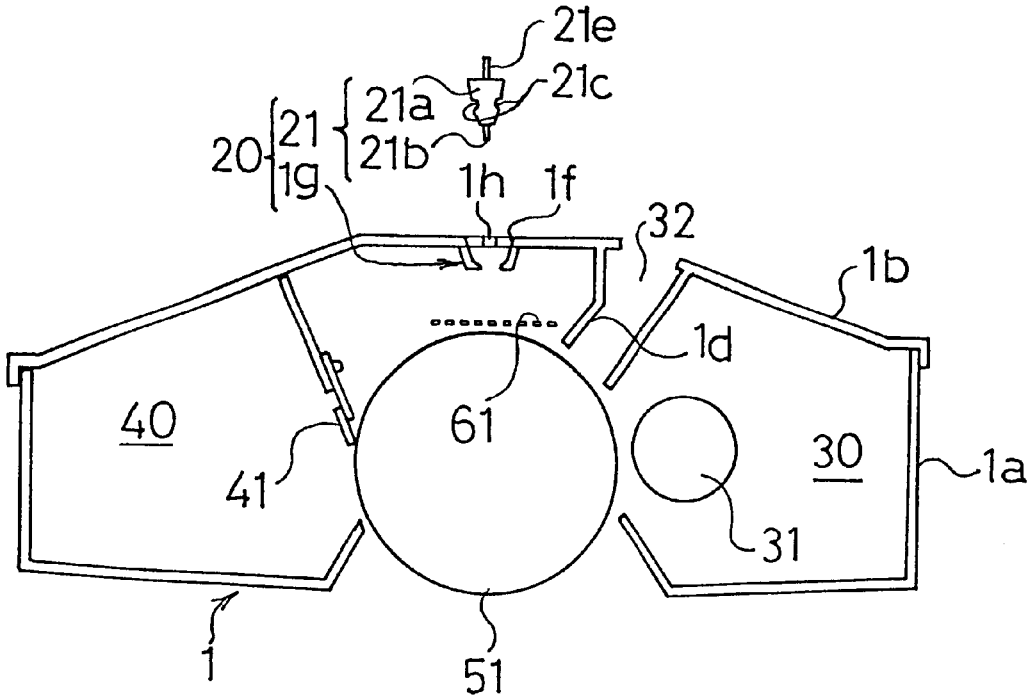
FIG. 7 is a sectional view showing the imaging cartridge of FIG. 6, with an electrode member taken out therefrom.
Figure 8:
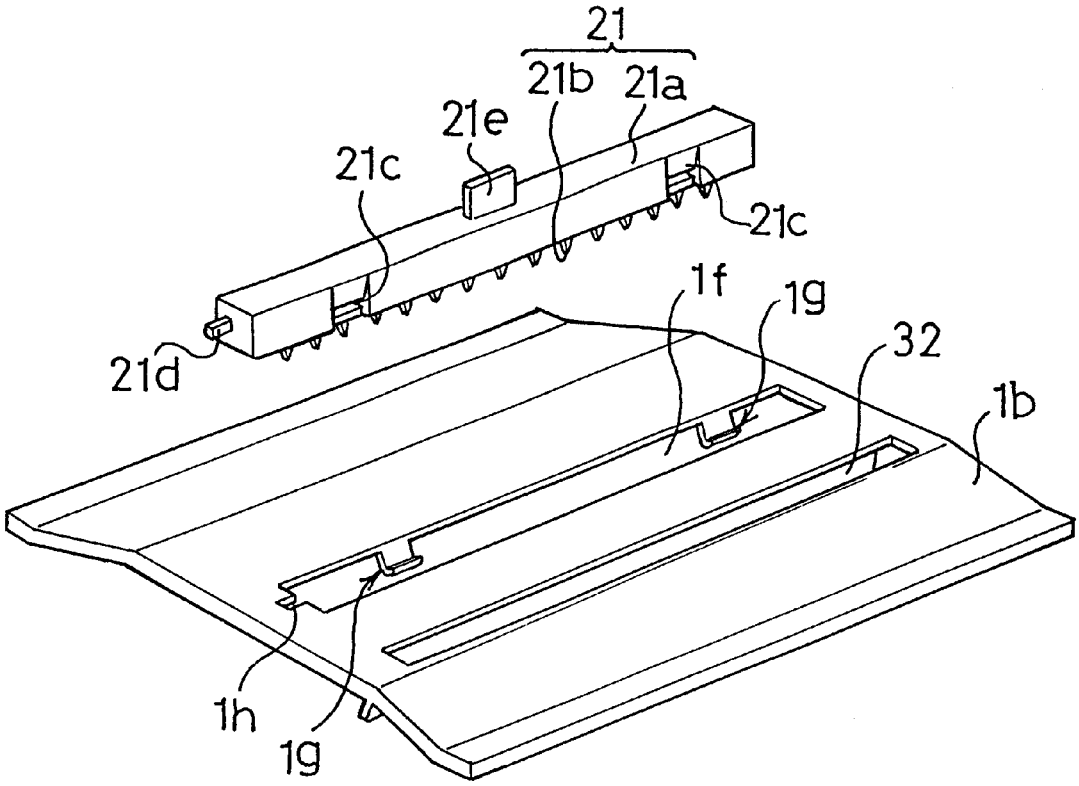
FIG. 8 is a perspective view showing a cover plate of the imaging cartridge of FIG. 6, with the electrode member taken out therefrom.

FIGS. 6 to 8 show a third embodiment of the present invention, in which the corona charging device 20 is comprised of the electrode member 21 and a pair of retaining clips 1*g*. The retaining clips 1*g* project downwardly from either edge of an electrode support slit 1*f* provided in the cover plate 1*b*, into which the electrode mold 21*a* is detachably inserted from the side opposite to the photosensitive drum 51. The retaining clips 1*g* have sufficient plastic resiliency between itself and the cover plate 1*b* to allow such insertion, and the electrode mold 21*a* is further provided with matching concaves 21*c* to couple with the retaining clips 1*g* as shown in FIG. 6.

The electrode member 21 is thereby fixedly held in the electrode support slit If without any additional fixing members or operation, just by inserting the electrode mold 21*a* into the slit if, by which the concaves 21*c* of the electrode mold 21*a* are resiliently mated with the retaining clips 1*g*.

The electrode support slit 1*f* has a cut 1*h* on one of the fore or rear edge thereof as shown in FIG. 8, by which a protrusion 21*d* on one end of the electrode mold 21*a* is received, so that the electrode member 21 can only be engaged with the electrode support slit 1*f* in a direction where the projection 21*d* and the cut 1*h* face to each other. The installation of the electrode member 21 can be thereby specified in a certain direction.

Further, a tab 21*e* is integrally made with and in the middle on a backside of the electrode mold 21*a*, which is just the opposite side of the discharging points 21*b*, whereby the electrode member 21 can be firmly held by a hand for a simple and safe operation of mounting and dismounting thereof.

Other parts which are identical with those of the first embodiment are given the same numerals, and the description thereof will be omitted.

(Fourth Embodiment)

Figure 9:
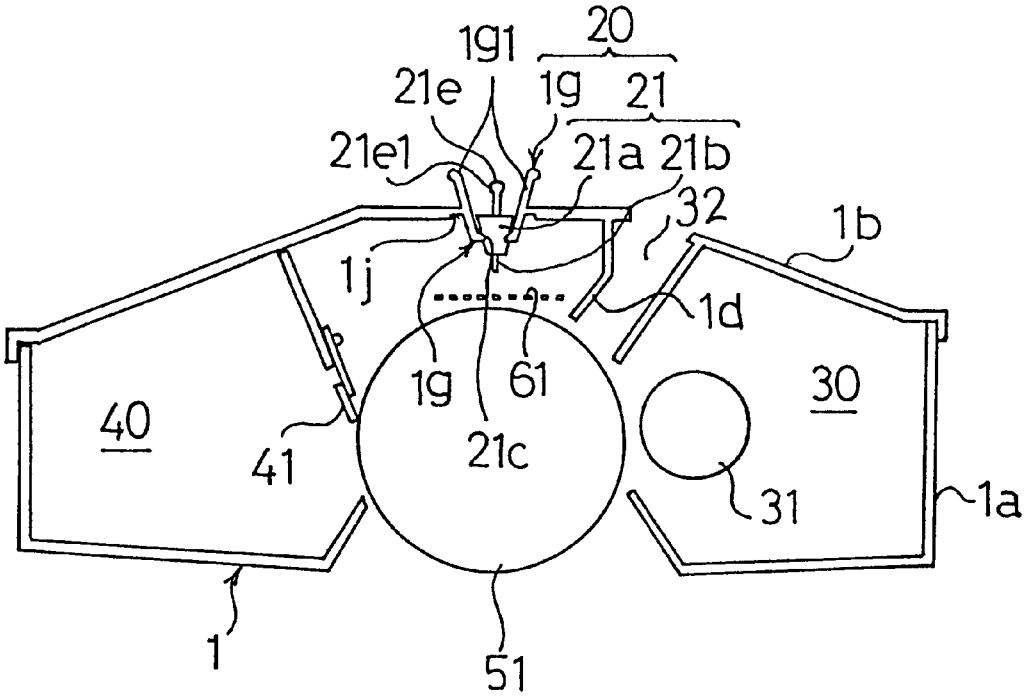
FIG. 9 is a sectional view showing an imaging cartridge in accordance with a fourth embodiment of the present invention.
Figure 10:
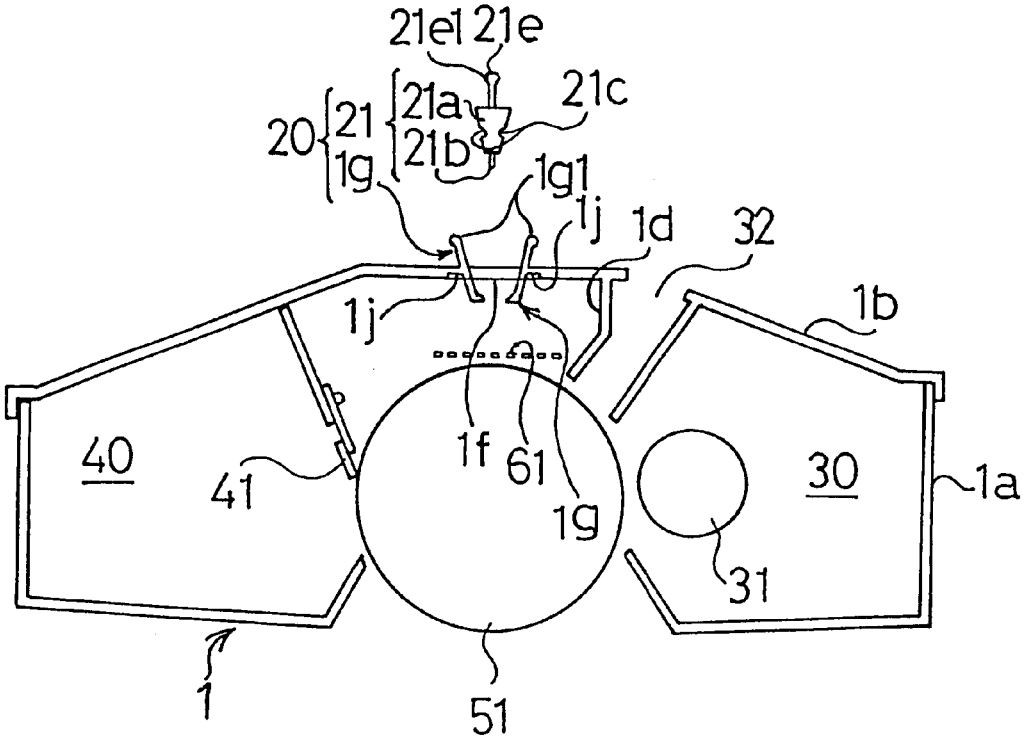
FIG. 10 is a sectional view showing the imaging cartridge of FIG. 9, with an electrode member taken out therefrom.
Figure 11:
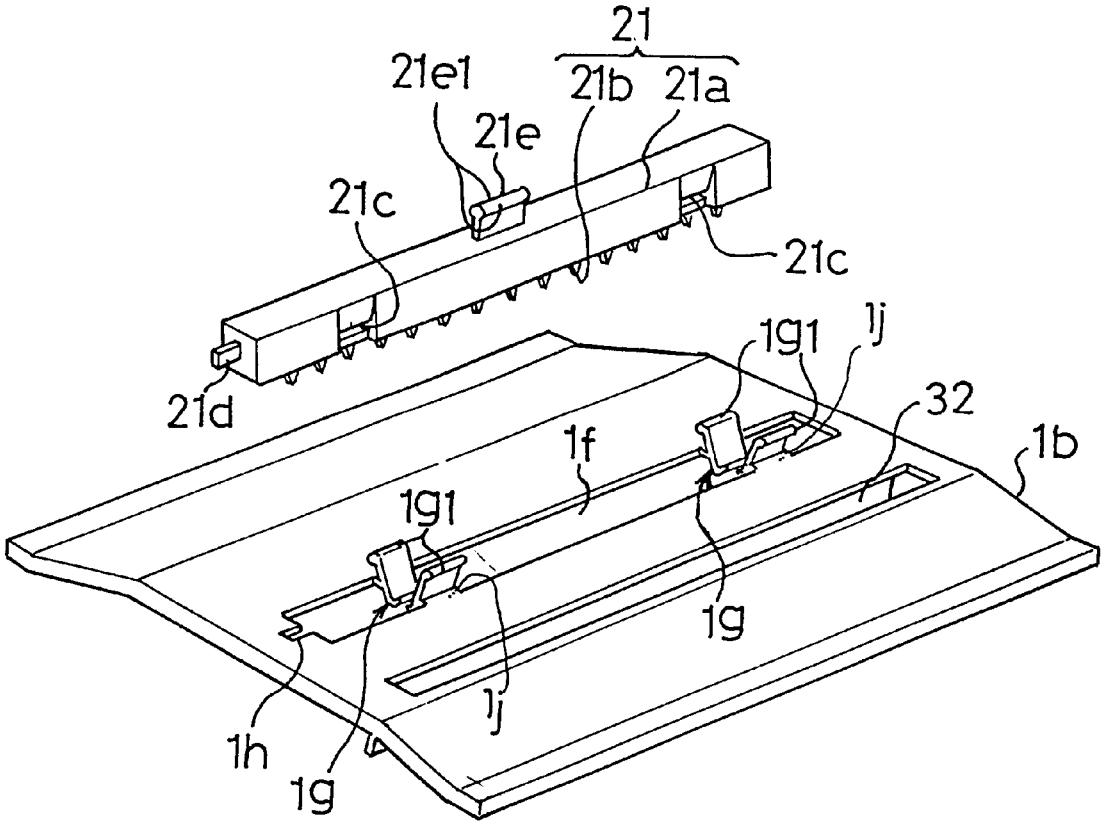
FIG. 11 is a perspective view showing a cover plate of the imaging cartridge of FIG. 9, with the electrode member taken out therefrom.

FIGS. 9 to 11 show a fourth embodiment of the present invention in which the retaining clips 1*g* of the third embodiment are modified to be uniformly connected to either edge of the electrode support slit 1*f* of the cover plate 1*b* by plastic hinges 1*j* and to have their respective operation parts 1*g*1 extending outwardly and upwardly from the cover plate 1*b*.

Other parts which are identical with those of the third embodiment are given the same numerals, and the description thereof will be omitted.

In this embodiment, when the electrode mold 21*a* is inserted between the retaining clips 1*g* from above, it is guided by the tapering operation parts 1*g*1 on both sides and easily engages with the retaining clips 1*g*. When the electrode mold 21*a* is completely inserted into the electrode support slip 1*f*, the matching concaves 21*c* on either side of the electrode mold 21*a* resiliently couple with the retaining clips 1*g*. The electrode member 21 is thus even more simply mounted thereto than the other prescribed embodiments.

In order to remove the electrode member 21, both operation parts 1*g*1 are nipped by fingers and pressed inwardly, by which both distal ends of the retaining clips 1*g* are separated from each other, releasing the resilient engagement between the concaves 21*c* and the clips 1*g*. The electrode member 21 is then simply picked up by the tab 21*e*.

Specifically, the tab 21*e* has a lug 21*e*1 slightly extending outwardly at its projecting end, which further facilitates the operation of mounting/dismounting the electrode member 21. Such arrangement may also be advantageous when applied to other embodiments.

(Fifth Embodiment)

Figure 12:
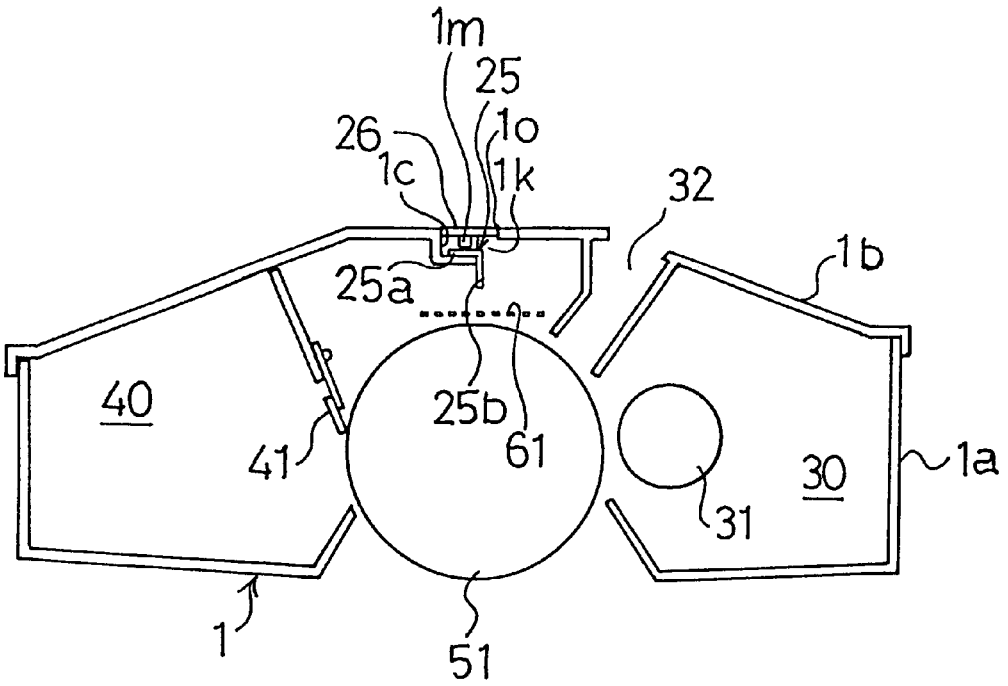
FIG. 12 is a sectional view showing an imaging cartridge in accordance with a fifth embodiment of the present invention.
Figure 13:
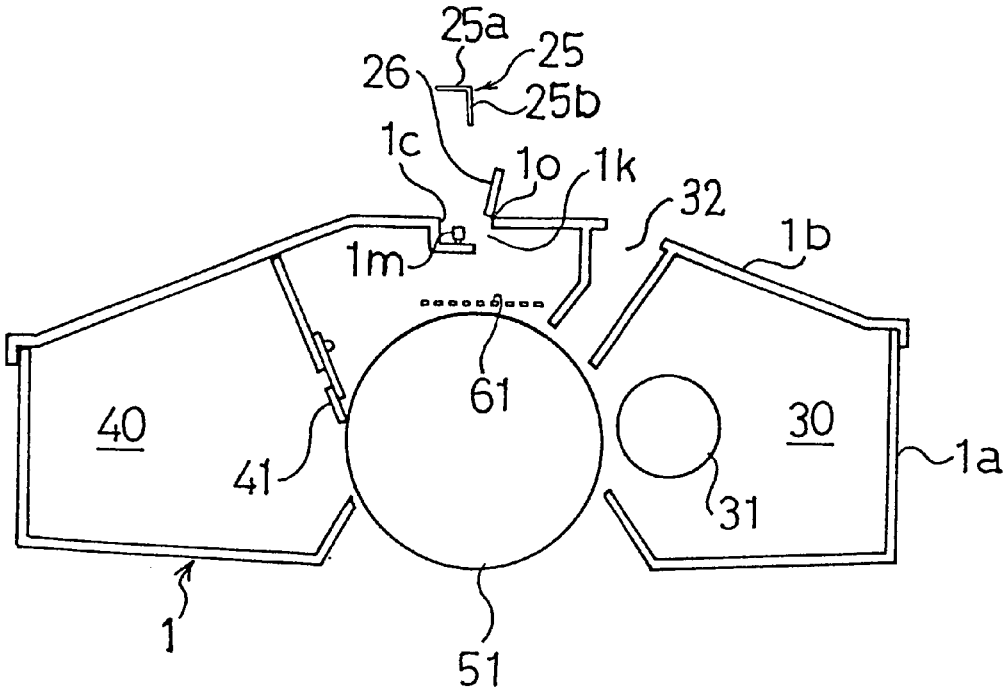
FIG. 13 is a sectional view showing the imaging cartridge of FIG. 12, with an electrode member taken out therefrom.
Figure 14A:
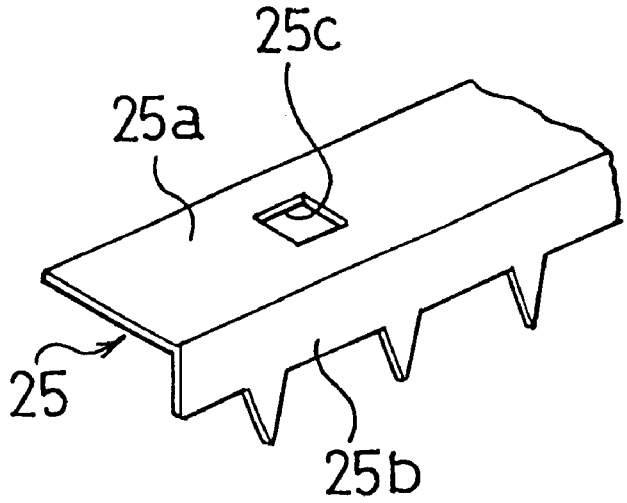
FIGS. 14A and 14B are perspective views showing the arrangement of supporting the electrode member in the imaging cartridge of FIG. 12.

A fifth embodiment of the present invention employs an electrode member 25 of another configuration having a right-angledly hooked cross-section comprising a mounting base 25*a* and a discharging part 25*b* as shown in FIGS. 12 to 14. The mounting base 25*a* of the electrode member 25 is provided with a plurality of matching holes 25*c* arranged along the length as shown in FIG. 14A. The electrode support slot 1*c* on the cover plate 1*b* has an opened space 1*k* on one side to communicate with the interior of the imaging cartridge 1 as shown in FIGS. 12 and 13. When the electrode member 25 is placed in the electrode support slot 1*c*, as best seen from FIG. 12, the mounting base 25*a* sits on the bottom of the slot 1*c* and the discharging part 25*b* extends downwardly through the opened space 1*k* into the imaging cartridge 1, where it opposes to the photosensitive drum 51 to charge the surface thereof.

Figure 14B:
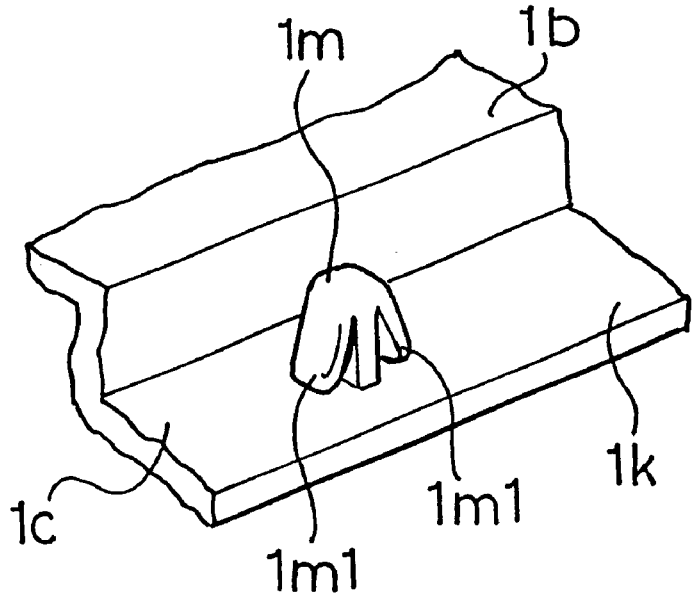

For mounting the electrode member 25 at its charging position, retaining bosses 1*m* are provided on the bottom of the electrode support slot 1*c* as shown in FIGS. 12, 13, and 14B, which are disposed at positions corresponding to the matching holes 25*c* for resiliently coupling therewith to keep the electrode member 25 in position. The retaining bosses 1m may be either made integrally with and on the bottom of the electrode support slot 1*c*, or provided separately. The retaining bosses 1*m* have a pair of coupling pieces 1*m*1 at their distal ends extending outwardly and downwardly like an arrowhead for preventing it from slipping off the matching holes 25*c*.

When the mounting base 25*a* of the electrode member 25 is set in the electrode support slot 1*c*, the matching holes 25*c* are coupled with the retaining bosses 1*m* from above, the coupling pieces 1*m*1 of the bosses 1*m* in the shape of an arrowhead being pushed inwardly until the mounting base 25*a* reaches the bottom of the electrode support slot 1*c*, where the coupling pieces 1*m*1, having completed to pass through the matching holes 25*c*, resile to extend outwardly. The coupling pieces 1*m*1 are caught by the edges of the matching holes 25*c*, by which the mounting base 25*a* is prevented from slipping off the bosses 1*m* and kept in tight contact with the bottom of the electrode support slot 1*c*. Accordingly, the electrode member 25 can be fixedly retained in the electrode support slot 1*c*, without any additional mounting means or operations, only by laying the mounting base 25*a* over the bottom of the electrode support slot 1*c*, the matching holes 25*c* of the mounting base 25*a* resiliently coupling with the retaining bosses 1*m* on the electrode support slot 1*c*.

The matching holes 25*c* can be smoothly released from the retaining bosses 1*m* by pinching the coupling pieces 1*m*1 of the bosses 1*m*, pushing them from both sides to narrow, and the electrode member 25 is simply picked up for removal therefrom.

The upper opening of the electrode support slot 1*c* is covered by a lid 26 uniformly made with and connected to the cover plate 1*b* by a plastic hinge 1*o*. The lid 26 is normally kept closed so as to prevent an external force to cause the mounting parts such as the retaining bosses 1*m* to loosen, as well as to make the outlook simpler.

(Sixth Embodiment)

Figure 15:
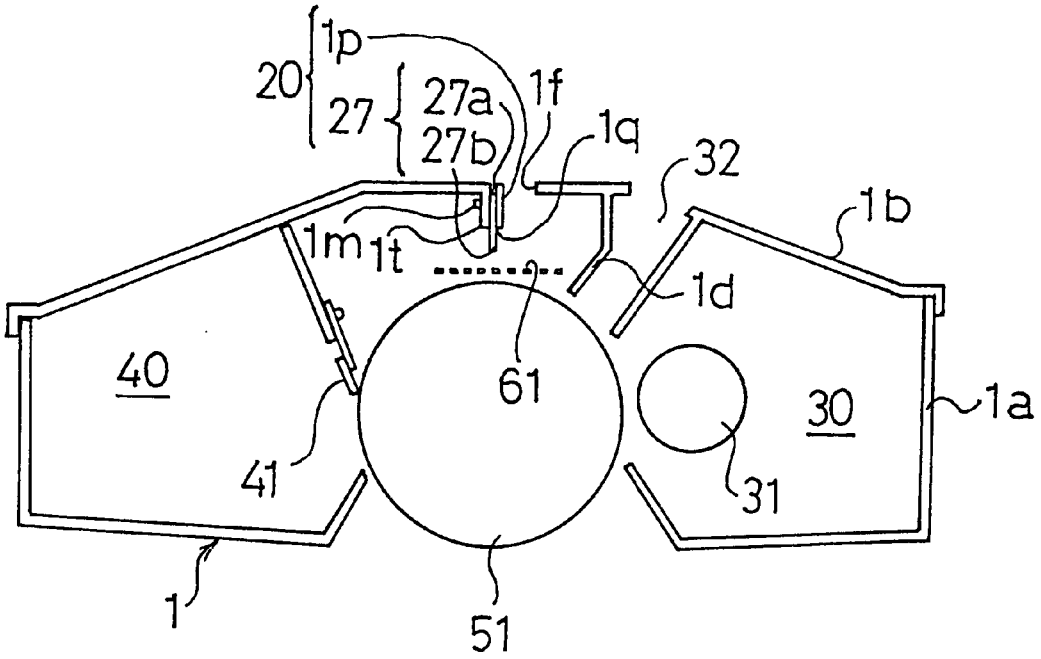
FIG. 15 is a sectional view showing an imaging cartridge in accordance with a sixth embodiment of the present invention.
Figure 16:
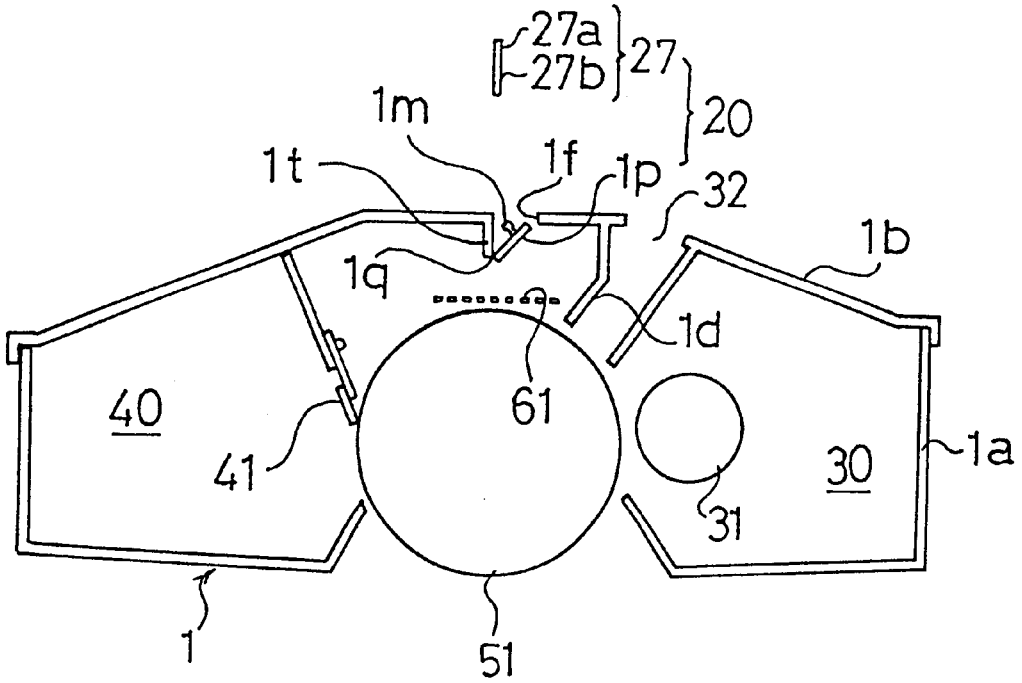
FIG. 16 is a sectional view showing the imaging cartridge of FIG. 15, with an electrode member taken out therefrom.
Figure 17A:
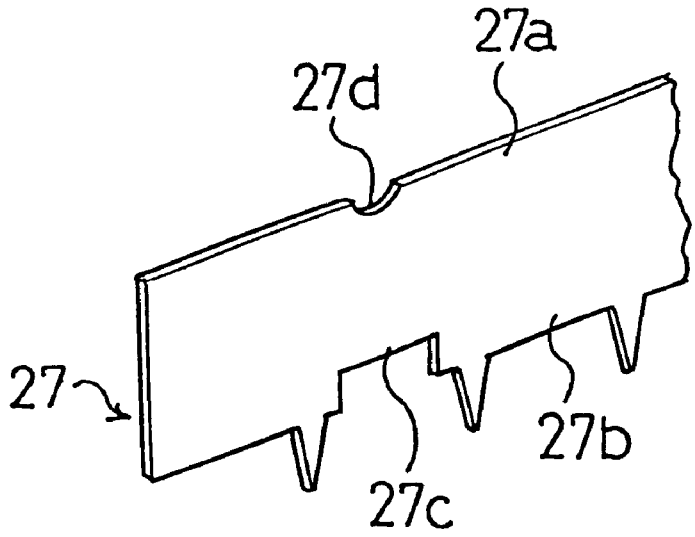
FIGS. 17A and 17B are perspective views showing an electrode member and an electrode supporting member of the imaging cartridge of FIG. 16.
Figure 17B:
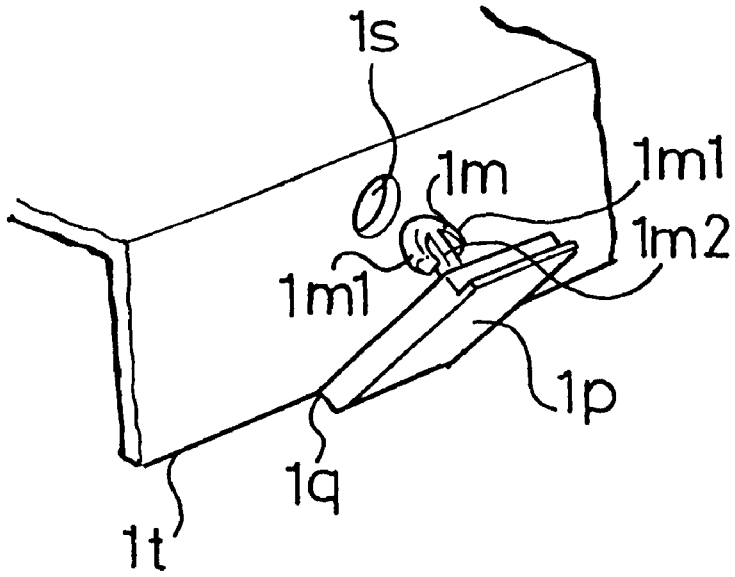

A sixth embodiment of the present invention shown in FIGS. 15 to 17 employs an electrode member 27 in the shape of a flat and elongated strip comprising a mounting base 27*a* and a discharging part 27*b* having a plurality of cuts 27*c* along the length on the lower edge thereof as best shown in FIG. 17A. The electrode member 27 is set to a mounting wall it integrally formed with and on one edge of the electrode support slit 1*f* opened on the cover plate 1*b*. An electrode retaining plate 1*p* is uniformly formed with and connected to the mounting wall 1*t* by a plastic hinge 1*q*. The electrode member 27 is held between the mounting wall 1*t* and the electrode retaining plate 1*p*, each cut 27*c* on its lower edge being coupled to the plastic hinge 1*q* so as to position the electrode member 27 in a certain direction along its length.

At a free end of the retaining plate 1*p* is a retaining boss 1*m* which is substantially identical to those described with respect to the fifth embodiment, which is resiliently mated with a retaining hole 1*s* provided on the mounting wall 1*t*, so that the electrode member 27 is fastened between the mounting wall 1*t* and the retaining plate 1*p*. To prevent a lateral movement of the electrode member 27, the mounting base 27*a* of the electrode member 27 is provided with a cut 27*d* on its upper edge, which contacts with and fits to a lower side of a shaft 1*m*2 of the retaining boss 1*m*. The electrode member 27 is thus firmly kept in a proper position within the electrode support slit 1*f* by the engagement between the cut 27*d* and the shaft 1*m*2 of the retaining boss 1*m*, and the engagement between the cut 27*c* and the plastic hinge 1*q*.

(Seventh Embodiment)

A seventh embodiment of the present invention is an arrangement of connection between the electrode member of the prescribed embodiments 1 to 6 to a power source. This embodiment employs the electrode member 21 which is substantially identical to those described with reference to the embodiments 1 to 3, but it is understood that the arrangement of this embodiment can also be applied to those electrode members of the embodiments 4 to 7.

Figure 18:
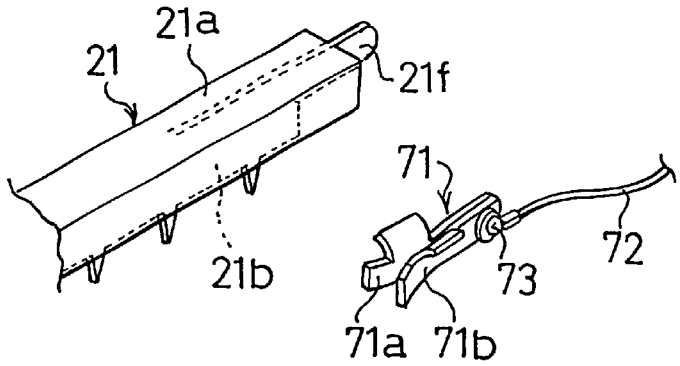
FIG. 18 is a perspective view showing an electrode member and a power source connector in accordance with a seventh embodiment of the present invention.

Specifically, the electrode member 21 is connected to a power source (not shown) which applies high voltage to the electrode member 21 for discharging by a power source connector 71 as shown in FIG. 18. A connecting terminal 21*f* is either integrally formed with or electrically connected to one end of the discharging point 21*b* of the electrode member 21 to project from the electrode mold 21*a*. The power source connector 71 comprises a pair of conductive clip members 71*a* and 71*b* secured by a screw 73 which also electrically connects the clip members 71*a* and 71*b* to a connector cord 72.

The power source connector 71 is disposed in a predetermined position, though not shown, within the imaging cartridge 1 as described with reference to the embodiments 1 to 6. When the electrode member 21 is mounted in a predetermined position in the imaging cartridge 1, the connecting terminal 21*f* of the electrode member 21 is inserted between the clip members 71*a* and 71*b* of the power source connector 71 which resiliently nip the connecting terminal 21*f*, thereby electrically connecting the electrode member 21 and the power source connector 71. When the electrode member 21 is taken out, the connecting terminal 21*f* is released from the engagement with the clip members 71*a* and 71*b*, and disconnected therefrom.

When the imaging cartridge 1 is installed for use in a certain position within the main body of an image forming apparatus, the connector cord 72 comes into electrical connection with a high voltage power source (not shown) disposed in the apparatus. When the imaging cartridge 1 is removed from the main body of the apparatus, the electrical connection between the imaging cartridge and the apparatus is released. If the imaging cartridge 1 is such a type that it is only drawn out of the apparatus and not removed therefrom, it is not necessary to provide a specific connecting mechanism between the connector cord 72 and the high voltage power source.

Although the electrode member 21 is connected to or disconnected from the high voltage power source through the power source connector 71 linking with the mounting and dismounting operation of the imaging cartridge 1 in this embodiment, the power source connector 71 may be omitted so as to directly connect the electrode member 21 to the high voltage power source or disconnect the same therefrom. Alternatively, a high voltage power source unit may be built in the imaging cartridge, although it may increase the cost of the imaging cartridge.

(Eighth Embodiment)

Figure 19A:
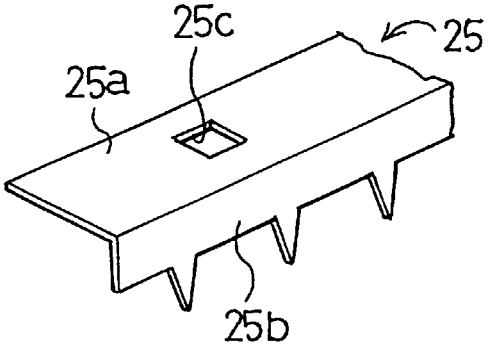
FIGS. 19A and 19B are perspective views showing an electrode member and an electrode supporting member of an imaging cartridge in accordance with an eighth embodiment of the present invention.
Figure 19B:
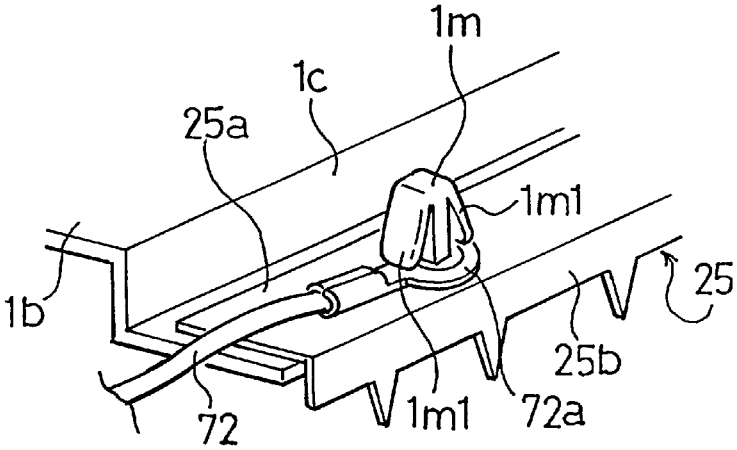

FIGS. 19A and 19B show another arrangement of electrical connection between an electrode member 21 and a power source according to an eighth embodiment of the present invention, in which the electrode member 25 of substantially the same configuration as that of the fifth embodiment is employed. When the mounting base 25*a* of the electrode member 25 is placed on the bottom of the electrode support slot 1*c* and mounted thereon by the engagement between the matching hole 25*c* as shown in FIG. 19A and the retaining boss 1*m*, a circular connecting terminal 72*a* at the end of the connecting cord 72 is overlappingly laid on the electrode member 25 so as to cause the retaining boss 1*m* to project through the matching hole 25*c* and the circular connecting terminal 72*a* as shown in FIG. 19B. The electrode member 25 is thereby not only retained in the electrode support slot 1*c* but also automatically connected to the connecting terminal 72*a* of the connecting cord 72. This embodiment allows the number of parts and assembling processes required for electrical connection between the electrode member 25 and the power source to be decreased.

(Ninth Embodiment)

Figure 20:
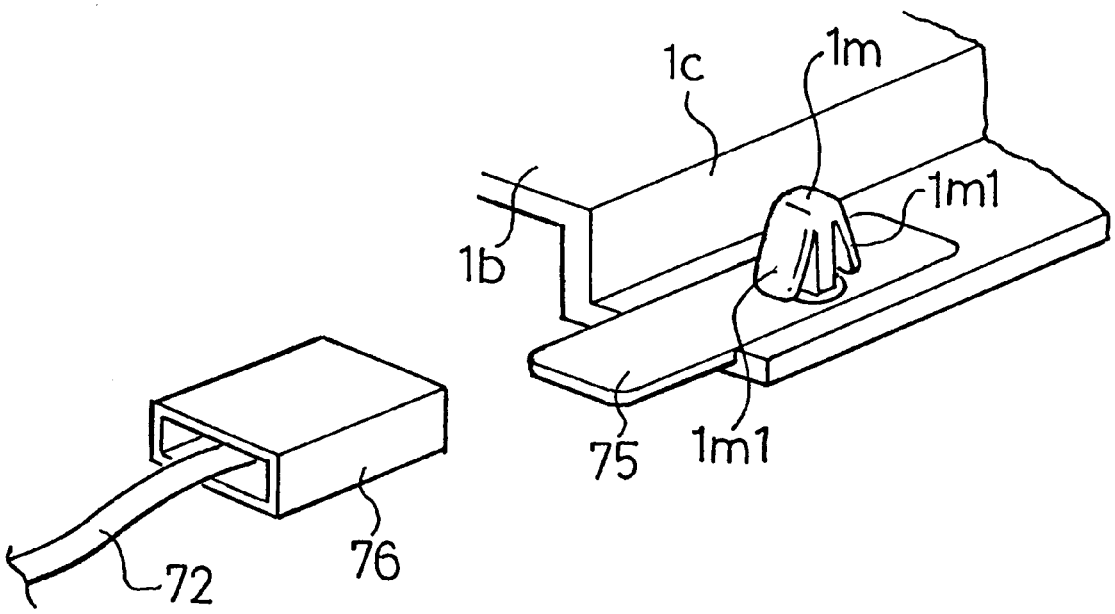
FIG. 20 is a perspective view showing an electrode supporting member of the imaging cartridge in accordance with a ninth embodiment of the present invention mounted with a power source connector.

A ninth embodiment of the present invention shown in FIG. 20 also employs the electrode member 25 and its support members of substantially the same configuration as that of the fifth embodiment. Instead of the connecting terminal 72*a* in the eighth embodiment, a planar power source connector 75 is coupled to the retaining boss 1*m*, so that the electrode member 25 comes into electrical contact with the power source connector 75 when the electrode member 25 is mounted by coupling its matching hole 25*c* to the retaining boss 1*m*. The planar power source connector 75 is linked to the connecting cord 72 via a connector 76 provided at a distal end of the connecting cord 72.

(Tenth Embodiment)

Figure 21:
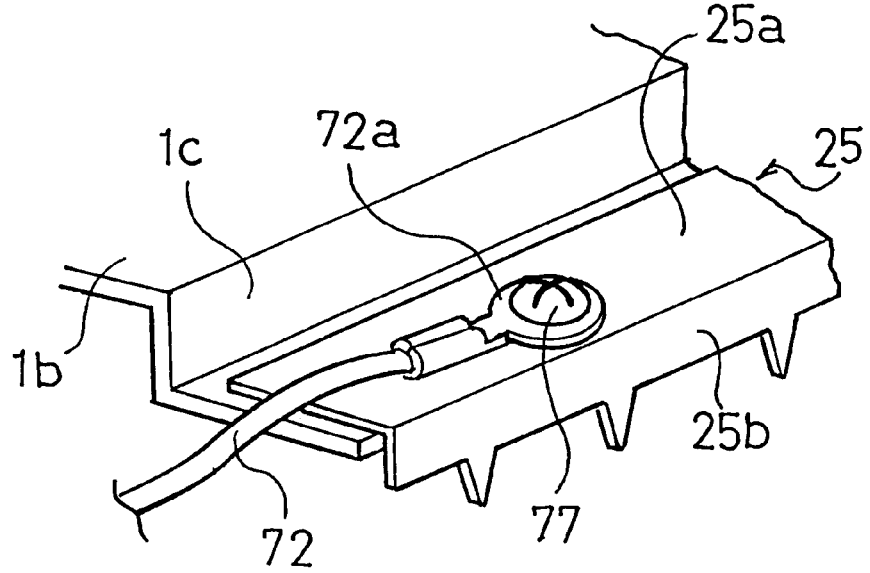
FIG. 21 is a perspective view showing an electrode member and an electrode supporting member of an imaging cartridge in accordance with a tenth embodiment of the present invention mounted with a power source connector.

A tenth embodiment of the present invention shown in FIG. 21 incorporates the electrode member 25 of the fifth embodiment with the connecting cord 72 of the eighth embodiment having the circular connecting terminal 72*a* at its end, in which the mounting base 25*a* is bolted to the bottom of the electrode support slot 1*c* together with the circular connecting terminal 72*a* by a common screw 77, thereby connecting the electrode member 25 directly with the connecting cord 72. The arrangement and the operation for electrical connection are further simplified in this embodiment.

(Eleventh Embodiment)

Figure 22A:
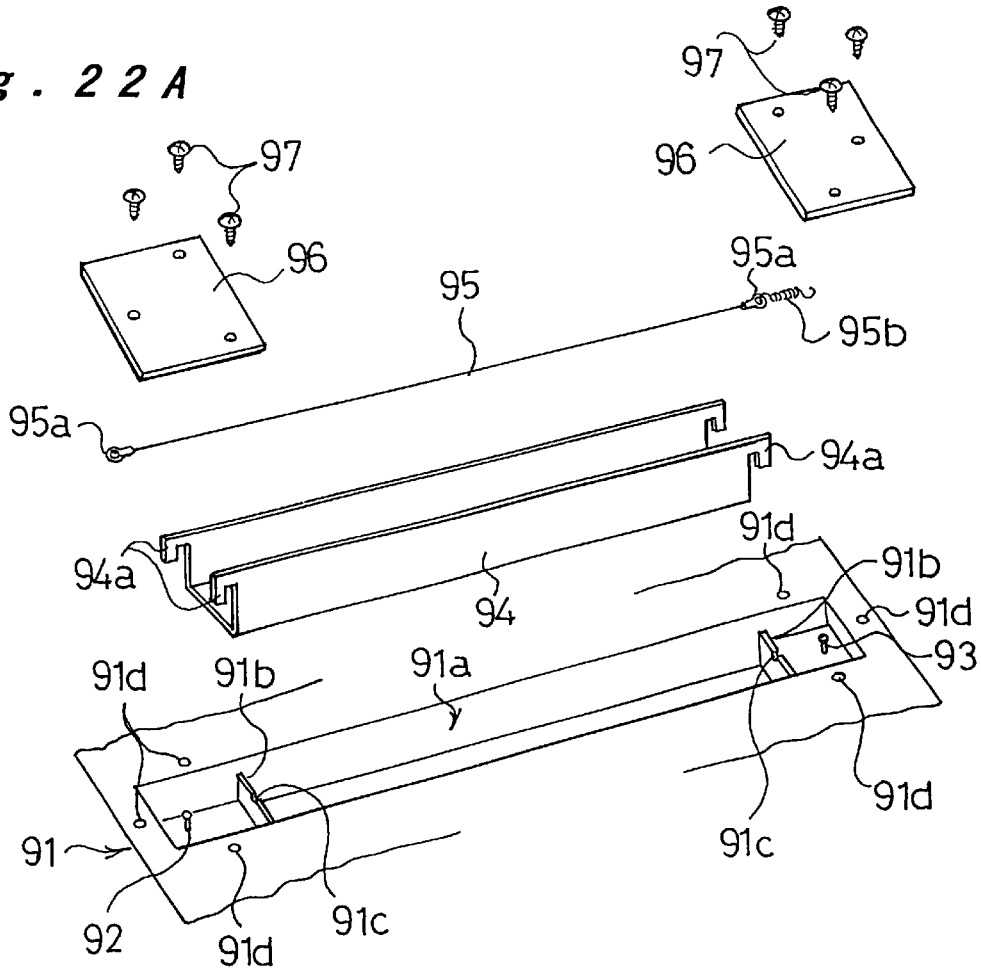
FIGS. 22A and 22B are perspective views showing an electrode member, an electrode supporting member, and a control scorotron grid of an imaging cartridge in accordance with an eleventh embodiment of the present invention.
Figure 22B:
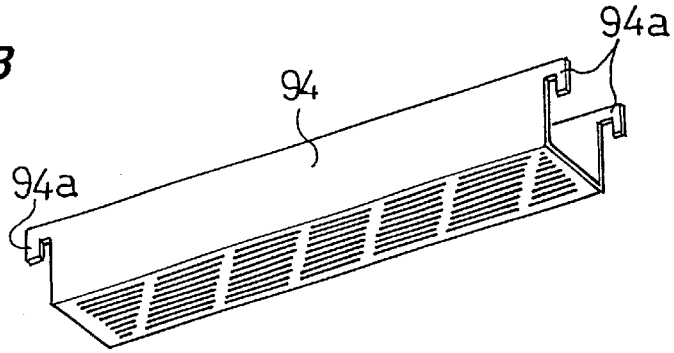

FIGS. 22A and 22B show an eleventh embodiment of the present invention which employs an electrode member 95 comprised of a wire. An imaging cartridge 91 of this embodiment comprises an electrode support housing 91*a* with its top opened so that the electrode member 95 can be mounted and dismounted from the side opposite to the photosensitive drum. Proximate to either end of the housing 91*a* are partition walls 91*b*, on which a discharge controlling scorotron grid 94 is placed by setting hooks 94*a* thereof on the partition walls 91*b* of the imaging cartridge 91. The scorotron grid 94 is thus also detached from and installed into the imaging cartridge 91 from the opposite side of the photosensitive drum.

The electrode member 95 is provided with a pair of wire stretching members 95*a* and springs 95*b* at both ends thereof, which are hooked to a pair of pins 92, 93, respectively, provided further proximate to either end of the housing 91*a* of the cartridge 91. The wire electrode member 95 is received and positioned in the vicinity of either end thereof by locator cuts 91*c* provided on the partition walls 91*b*, thereby the electrode member 95 is tightly stretched between both partition walls 91*b*, yet easily detachable therefrom.

Both ends of the housing 91 are also provided with covers 96 which are mounted thereto and dismounted therefrom by screws 97 through matching holes 91*d*. The covers 96 prevent the scorotron grid 94 from loosening or slipping out of place as well as prevent leak from the high voltage unit in the electrode support housing 91*a*.

(Twelfth Embodiment)

Figure 23:
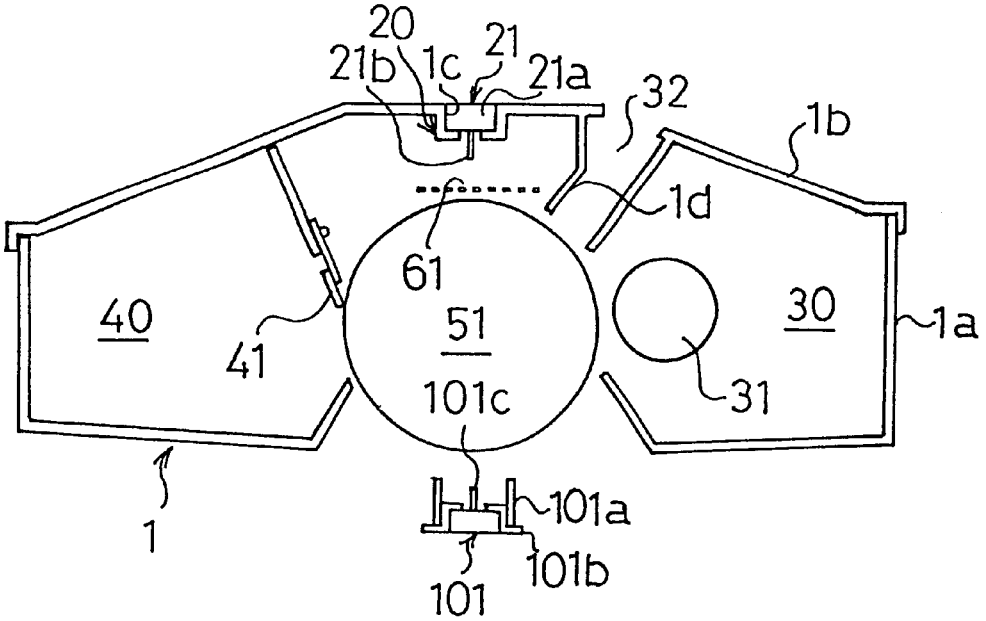
FIG. 23 is a sectional view showing an imaging cartridge in accordance with a twelfth embodiment of the present invention.
Figure 24:
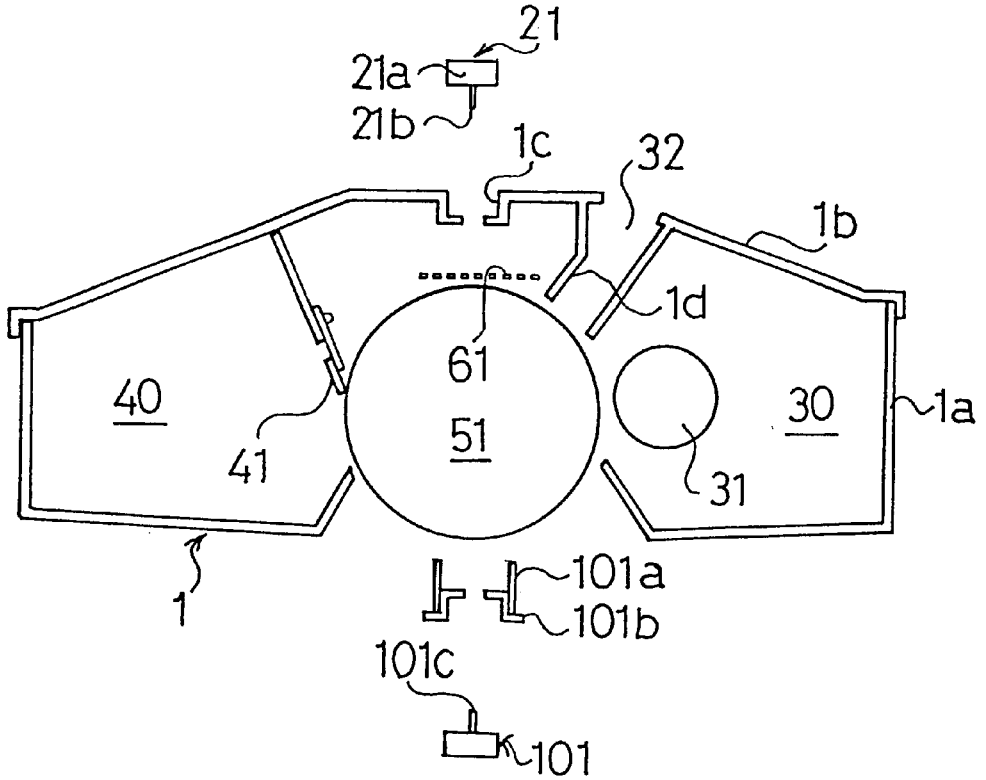
FIG. 24 is a sectional view showing the imaging cartridge of FIG. 23, with an electrode member taken out therefrom.

A twelfth embodiment of the present invention shown in FIGS. 23 and 24 is the imaging cartridge 1 including the scorotron grid 61 in combination therewith as in the first embodiment, further comprising a transfer charger 101 equipped therein. The transfer charger 101 includes a conductive discharge control plate 101*a*, an electrode support member 101*b* integrally made with the casing 1*a* of the imaging cartridge 1 and a discharging point 10c, which is detachable from the side opposite to the photosensitive drum 51 just as the electrode member 21. Such arrangement of including the transfer charger 101 within the imaging cartridge 1 allows for more precise positioning of discharging electrodes of the transfer charger 101 with respect to the photosensitive drum 51. Also, in such an arrangement, it is unlikely that a user puts his fingers into the transfer charger 101 accidentally during an operation of removing a jammed paper and damages the electrodes or gets injured by pointed discharging electrodes.

The device incorporated in the cartridge is not limited to the transfer charger as has been described in this embodiment, and may be a separating charger equipped in a similar arrangement. Also, discharging electrodes may be wire electrodes instead of pin-like electrodes.

It is to be understood that the provision of a conductive or an insulating discharge control plate to the prescribed embodiments 1 to 5 shown in FIGS. 2 to 16 would not change any effects or advantages of those embodiments.

Instead of a pin-like or wire electrode, a fixed discharging electrode comprising a conductive electrode, a dielectric member disposed in the proximity thereof, and an opposing electrode thereabove or in the vicinity thereof may be employed, or any other members which contact the surface of an object to be charged such as a roller, brush, blade, or film may be selected as a discharging electrode.

According to the present invention, an electrode member can be independently detached by a simple operation without dismounting an object to be charged or a scorotron grid, owing to which assembly process in production or any other operations by a serviceman or a user can be simplified. It is prevented that the electrode member may be damaged by contacting other members or falling. The time and cost for maintenance can be reduced as well as the number of parts to be exchanged can be minimized.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An imaging cartridge, for detachable incorporation in an image forming apparatus, comprising:

a main body of the imaging cartridge having an opening formed therein;

a corona charging device including;

an electrode member; and an electrode supporting member for supporting said electrode member; and a retaining means for detachably keeping the electrode member in place when mounted in the main body of the imaging cartridge in the electrode supporting member; wherein the retaining means is so constructed that the electrode member and the electrode supporting member are magnetically attracted to each other.

2. An imaging cartridge, for detachable incorporation in an image forming apparatus, comprising:

a main body of the imaging cartridge having an opening formed therein;

a corona charging device including;

an electrode member; and an electrode supporting member for supporting said electrode member; and a retaining means for detachably keeping the electrode member in place when mounted in the main body of the imaging cartridge in the electrode supporting member; wherein a detachably mounted grid electrode is incorporated in the main body of the imaging cartridge.

3. An imaging cartridge, for detachable incorpolation in an image forming apparatus, comprising:

a main body of the imaging cartridge having an opening formed therein;

a corona charging device including;

an electrode member; and an electrode supporting member for supporting said electrode member; and a retaining means for detachably keeping the electrode member in place when mounted in the main body of the imaging cartridge in the electrode supporting member; wherein said electrode supporting member comprises a slot for supporting said electrode member and said electrode member is magnetically attracted to said slot.

4. An imaging cartridge, for detachable incorporation in an image forming aparatus, comprising:

a main body of the imaging cartridge having an opening formed therein;

a corona charging device including;

an electrode member; and an electrode supporting member for supporting said electrode member; and a retaining means for detachably keeping the electrode member in place when mounted in the main body of the imaging cartridge in the electrode supporting member; wherein said electrode supporting member comprises a slot for supporting said electrode member and said cartridge includes a detachable cover plate which accommodates said slot.

5. An imaging cartridge, for detachable incorporation in an image forming apparatus, comprising:

a main body of the imaging cartridge having an opening formed therein;

a corona charging device including;

an electrode member; and an electrode supporting member for supporting said electrode member; and a retaining means for detachably keeping the electrode member in place when mounted in the main body of the imaging cartridge in the electrode supporting member; wherein said cartridge is equipped with a photosensitive drum as an object to be charged within said main body, wherein said electrode member is independently detachable without dismounting said photosensitive drum.

6. An image cartridge according to claim 5, wherein said cartridge also includes a grid electrode disposed between said electrode member and said photosensitive drum.

7. An imaging cartridge comprising:

a main body of the imaging cartridge having an opening formed therein;

a corona charging device including:

an electrode member; and an electrode supporting member; and a retaining means for detachably keeping the electrode member in place when mounted in the main body of the imaging cartridge, wherein the retaining means is so constructed that either one of a periphery of the opening of the imaging cartridge or the electrode member is composed of a magnetic material and the other is made to have a magnetic polarity.

8. A corona charging device comprising:

an electrode member;

an electrode supporting member; and a retaining means for detachably keeping the electrode member at a predetermined mounted portion;

wherein the retaining means is so constructed that either one of the mounted portion or the electrode member is composed of a magnetic material and the other is made to have a magnetic polarity.

9. An imaging cartridge, comprising:

a main body;

a photosensitive drum;

an electrode member comprising an electrode mold member and a discharging member;

a supporting member for detachably receiving said electrode mold member, such that said discharging member protrudes toward said photosensitive member into said main body of the cartridge, and;

a retaining means for detachably keeping the electrode member in said supporting member, wherein said discharging member is detached from said imaging cartridge from an opposite side of the photosensitive drum, and wherein said retraining means includes means for creating magnetic attraction between said electrode member and said supporting member.

10. An imaging cartridge, comprising a main body;

a photosensitive drum;

an electrode member comprising an electrode mold member and a discharging member; and a supporting member for detachably receiving said electrode mold member, such that said discharging member protrudes toward said photosensitive member into said main body of the cartridge, wherein said discharging member is detached from said imaging cartridge from an opposite side of the photosensitive drum, and wherein said electrode member is independently detachable without dismounting said photosensitive drum.

11. An imaging cartridge, for detachable incorporation in an image forming apparatus, comprising:

a main body of the imaging cartridge having an opening formed therein;

a grid electrode incorporated in said main body;

a corona charging device including;

a discharging electrode; and an electrode supporting member for supporting said discharging electrode; and a retaining means for detachably keeping said discharging electrode in place when mounted in the main body of the imaging cartridge in the electrode supporting member, wherein said discharging electrode can be detached without dismounting said grid electrode.

* * * * *